US006796291B2

(12) United States Patent
Suzuki et al.

(10) Patent No.: US 6,796,291 B2
(45) Date of Patent: Sep. 28, 2004

(54) INTAKE PRESSURE SENSOR ARRANGEMENT FOR ENGINE

(75) Inventors: Masaru Suzuki, Hamamatsu (JP); Hitoshi Watanabe, Hamamatsu (JP)

(73) Assignee: Yamaha Marine Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 10/113,784

(22) Filed: Mar. 29, 2002

(65) Prior Publication Data

US 2002/0152993 A1 Oct. 24, 2002

Related U.S. Application Data

(63) Continuation-in-part of application No. 09/906,389, filed on Jul. 16, 2001.

(30) Foreign Application Priority Data

Jul. 14, 2000 (JP) ..... 2000-215161
Jul. 12, 2001 (JP) ..... 2001-212736

(51) Int. Cl.[7] ..... F02M 1/00
(52) U.S. Cl. ..... 123/463; 123/494; 123/511
(58) Field of Search ..... 123/494, 457, 123/511, 463, 445, 447

(56) References Cited

U.S. PATENT DOCUMENTS 4,010,717 A 3/1977 Taplin
4,412,520 A 11/1983 Mitsuyasu et al.
4,413,602 A 11/1983 Inoue et al.
4,538,577 A * 9/1985 Nomura et al. ..... 12/452
4,546,746 A * 10/1985 Sato et al. ..... 123/478
4,656,987 A * 4/1987 Arpaia ..... 123/463
4,671,240 A * 6/1987 Tanaka et al. ..... 123/463
4,930,482 A 6/1990 Kako
4,936,278 A 6/1990 Umeda (List continued on next page.)

FOREIGN PATENT DOCUMENTS

JP 9-088623 3/1997
JP 9-324713 12/1997
JP 2000-186653 7/2000
JP 2000-192831 7/2000

OTHER PUBLICATIONS

Yamaha F115A and FL115Y Service Manual, 1st edition, Jan. 2000, cover page and pp. 8–1, 8–5, published by Yamaha Motor Co., Ltd.
Chowanietz, Eric, *Automobile Electronics*, Copyright 1995, pp. 109–112, published by Society of Automotive Engineers, Inc.

*Primary Examiner*—John T. Kwon
(74) *Attorney, Agent, or Firm*—Knobbe, Martens, Olson & Bear, LLP

(57) ABSTRACT

A multi-cylinder engine includes a plurality of combustion chambers and employs an improved intake pressure sensor arrangement to control fuel injection into the combustion chambers. A plurality of intake conduits define intake passages through which air flows to the combustion chambers. An intake pressure sensor senses intake pressure within the intake passages. A plurality of first conduits are coupled with an accumulator independent of one another and a second conduit is also coupled with the accumulator. The first conduits connect the accumulator to the respective intake passages. The second conduit connects the accumulator to the intake pressure sensor. A control device controls the amount of fuel injected into the combustion chambers based upon at least a signal from the intake pressure sensor.

20 Claims, 5 Drawing Sheets

U.S. PATENT DOCUMENTS 4,966,105 A * 10/1990 Mori ..... 123/73 AD
5,241,939 A 9/1993 Nonaka
5,579,736 A 12/1996 Nakamura et al.
5,579,745 A 12/1996 Katoh et al.
5,584,281 A * 12/1996 Katoh ..... 123/681
5,586,524 A 12/1996 Nonaka et al.
5,598,823 A * 2/1997 Povinger ..... 123/463
5,673,670 A * 10/1997 Powell et al. ..... 123/463
5,673,676 A 10/1997 Mukumoto
5,694,909 A 12/1997 Kato
5,704,334 A 1/1998 Kato
5,709,198 A 1/1998 Sagisaka et al.
5,711,148 A * 1/1998 Katoh ..... 60/276
5,712,422 A 1/1998 Kato
5,724,951 A 3/1998 Mukumoto
5,727,536 A 3/1998 Kato
5,762,053 A 6/1998 Anamoto
5,813,390 A 9/1998 Anamoto
5,829,402 A 11/1998 Takahashi et al.
5,832,907 A 11/1998 Kato
5,873,347 A 2/1999 Kato et al.
5,911,610 A 6/1999 Fujimoto
5,915,363 A 6/1999 Iwata et al.
5,918,275 A 6/1999 Kato et al.
5,918,584 A 7/1999 Kato
5,921,220 A 7/1999 Kato
5,924,409 A 7/1999 Kato
5,937,825 A 8/1999 Motose
5,941,223 A 8/1999 Kato
5,957,108 A 9/1999 Kato
5,983,878 A 11/1999 Nonaka et al.
6,015,319 A 1/2000 Tanaka
6,041,758 A 3/2000 Ishii
6,067,956 A 5/2000 Motose et al.
6,067,957 A 5/2000 Motose et al.
6,116,228 A 9/2000 Motose et al.
6,119,453 A 9/2000 Motose et al.
6,135,095 A 10/2000 Motose et al.
6,227,172 B1 5/2001 Katayama et al.
6,279,372 B1 8/2001 Zhang
6,286,492 B1 9/2001 Kanno

* cited by examiner

INTAKE PRESSURE SENSOR ARRANGEMENT FOR ENGINE

PRIORITY INFORMATION

The present application is a continuation-in-part of application Ser. No. 09/906,389, filed Jul. 16, 2001. This application also is based on and claims priority to Japanese Patent Application No. 2000-215161, filed Jul. 14, 2000 and priority to Japanese Patent Application No. 2001-212736, filed Jul. 12, 2001. The entire contents of these previous applications are hereby expressly incorporated by reference.

BACKGROUND OF THE INVENTION

1. Field of the Invention

The present invention relates generally to an intake pressure sensor arrangement for an engine, and more particularly to an improved intake pressure sensor arrangement for a multi-cylinder engine.

2. Description of Related Art

In all fields of engine design, there is increasing emphasis on obtaining high performance in output and more effective emission control. This trend has resulted in employing, for example, a fuel injected, multi-cylinder, four-cycle engine. The engine can have a direct or indirect fuel injection system and multiple cylinders such as, for example, six cylinders arranged in V-configuration. The fuel injection system enables the engine to be more responsive to operator demand, which may rapidly change. For example, the operator may desire that the engine rapidly accelerate and then rapidly decelerate within a short period of time. Fuel injection is an advantageous manner to achieve fuel economy and responsiveness under such engine operating conditions.

The fuel injection system and other sophisticated electrical devices associated with the engine require a high performance control system, which can include a control unit such as, for example, an electronic control unit (ECU), and various sensors that can sense the operator's demands and surrounding conditions; both of which can rapidly change.

The sensors may include an intake pressure sensor that senses an intake air pressure within the intake passages. The signal sent by the intake pressure sensor, which is indicative of the intake air pressure, is highly important to determining a proper amount of fuel for injection. Typically, one intake pressure sensor is employed for a multi-cylinder engine and one of the intake passages carries the sensor. However, due to different conditions of the respective intake passages, an intake pressure sensed by the single sensor may not accurately reflect the intake pressure present in the other intake passages. Each intake passage, therefore, preferably has its own sensor. The intake pressure sensor, however, is relatively expensive. Such an approach thus has been viewed as cost prohibitive or undesirable. To address these concerns, another approach has involved a combination of an intake pressure sensor with multiple conduits connecting the sensor with the respective intake passages is proposable. U.S. Pat. No. 6,227,172 discloses an example of such an arrangement in which a single intake pressure sensor is connected to four intake passages via a conduit. The conduit bifurcates twice to reach the respective intake passages. As such, the conduit can neatly and symmetrically be divided with an even number intake passage construction. However, this is not true with an odd number intake passage construction such as three intake passages. In addition, pulsation can occur with the odd number passage construction that can affect a sensed signal because the bifurcation must be unsymmetrical.

SUMMARY OF THE INVENTION

A need therefore exists for an intake pressure sensor arrangement for an engine that can be simple in design and can inhibit the occurrence of pressure pulsation even with odd number intake passages.

In accordance with one aspect of the present invention, an internal combustion engine comprises an engine body. A plurality of moveable members are moveable relative to the engine body. The engine body and the moveable members together define a plurality of combustion chambers. A plurality of intake conduits define intake passages through which air flows. An intake pressure sensor is configured to sense intake pressure within the intake passages. An accumulator is provided and defines at least first and second outer surfaces. A plurality of first conduits is coupled with the first surface. At least one second conduit is coupled with the second surface. The first conduits connect the accumulator to the respective intake passages. The second conduit connect the accumulator to the intake pressure sensor. At least one fuel injector is arranged to spray fuel for combustion in the combustion chambers. A control device is configured to control the fuel injector based upon at least a signal of the intake pressure sensor.

In accordance with another aspect of the present invention, an internal combustion engine comprises an engine body. A plurality of moveable members are moveable relative to the engine body. The engine body and the moveable members together define a plurality of combustion chambers. A plurality of intake conduits define intake passages through which air flows. The intake conduits extend generally horizontally. An intake pressure sensor is configured to sense intake pressure within the intake passages. An accumulator is provided and defines at least bottom and vertical outer surfaces. A plurality of first conduits are coupled with one of the bottom and vertical surfaces. At least one second conduit is coupled with the remainder surface of the bottom and vertical surfaces. The first conduits connect the accumulator to the respective intake passages. The second conduit connects the accumulator to the intake pressure sensor. At least one fuel injector is arranged to spray fuel for combustion in the combustion chambers. A control device is configured to control the fuel injector based upon at least a signal of the intake pressure sensor.

In accordance with a further aspect of the present invention, an outboard motor comprises an internal combustion engine. A support member is arranged to support the engine. The engine comprises an engine body. A plurality of moveable members are moveable relative to the engine body. The engine body and the moveable members together define a plurality of combustion chambers. A plurality of intake conduits define intake passages through which air flows. An intake pressure sensor is configured to sense intake pressure within the intake passages. An accumulator is provided and defines at least first and second outer surfaces. A plurality of first conduits is coupled with the first surface. At least one second conduit is coupled with the second surface. The first conduits connect the accumulator to the respective intake passages. The second conduit connect the accumulator to the intake pressure sensor. At least one fuel injector is arranged to spray fuel for combustion in the combustion chambers. A control device is configured to control the fuel injector based upon at least a signal of the intake pressure sensor.

In accordance with an additional aspect of the present invention, an internal combustion engine comprises an engine body and a plurality of moveable members that are moveable relative to the engine body. The engine body and the moveable members together define a plurality of combustion chambers. A plurality of intake conduits define intake passages through which air flows to the combustion chambers, and an intake pressure sensor is configured to sense intake pressure within the intake passages. The intake pressure sensor is connected to the intake passages via an accumulator. A plurality of first conduits connect the accumulator to the respective intake passages. Each of the first conduits is coupled to the accumulator separately of the other first conduits. At least one second conduit is coupled with the accumulator, and the second conduit connects the accumulator to the intake pressure sensor. A least one fuel injector is arranged to spray fuel for combustion in the combustion chambers, and a control device is configured to control the fuel injector based upon at least a signal of the intake pressure sensor.

Another aspect of the invention involves an internal combustion engine comprising an engine body and a plurality of moveable members moveable relative to the engine body. The engine body and the moveable members together define a plurality of combustion chambers. A plurality of intake conduits define intake passages through which air flows to the combustion chambers. An intake pressure sensor is configured to sense intake pressure within the intake passages. A plurality of first conduits are coupled with an accumulator, and at least one second conduit is coupled with the accumulator. The first conduits connect the accumulator to the respective intake passages, and the second conduit connects the accumulator to the intake pressure sensor. At least one fuel injector is arranged to spray fuel for combustion in the combustion chambers. A fuel pressure regulator communicates with the fuel injector to regulate fuel pressure at the fuel injector, and a third conduit connects the accumulator to the fuel pressure regulator.

These and other aspects of the present invention will become readily apparent to those skilled in the art from the following detailed description of the preferred embodiment. The invention is not limited, however, to the particular embodiment disclosed.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise five figures.

DETAILED DESCRIPTION OF THE PREFERRED EMBODIMENT OF THE INVENTION

Figure 1:
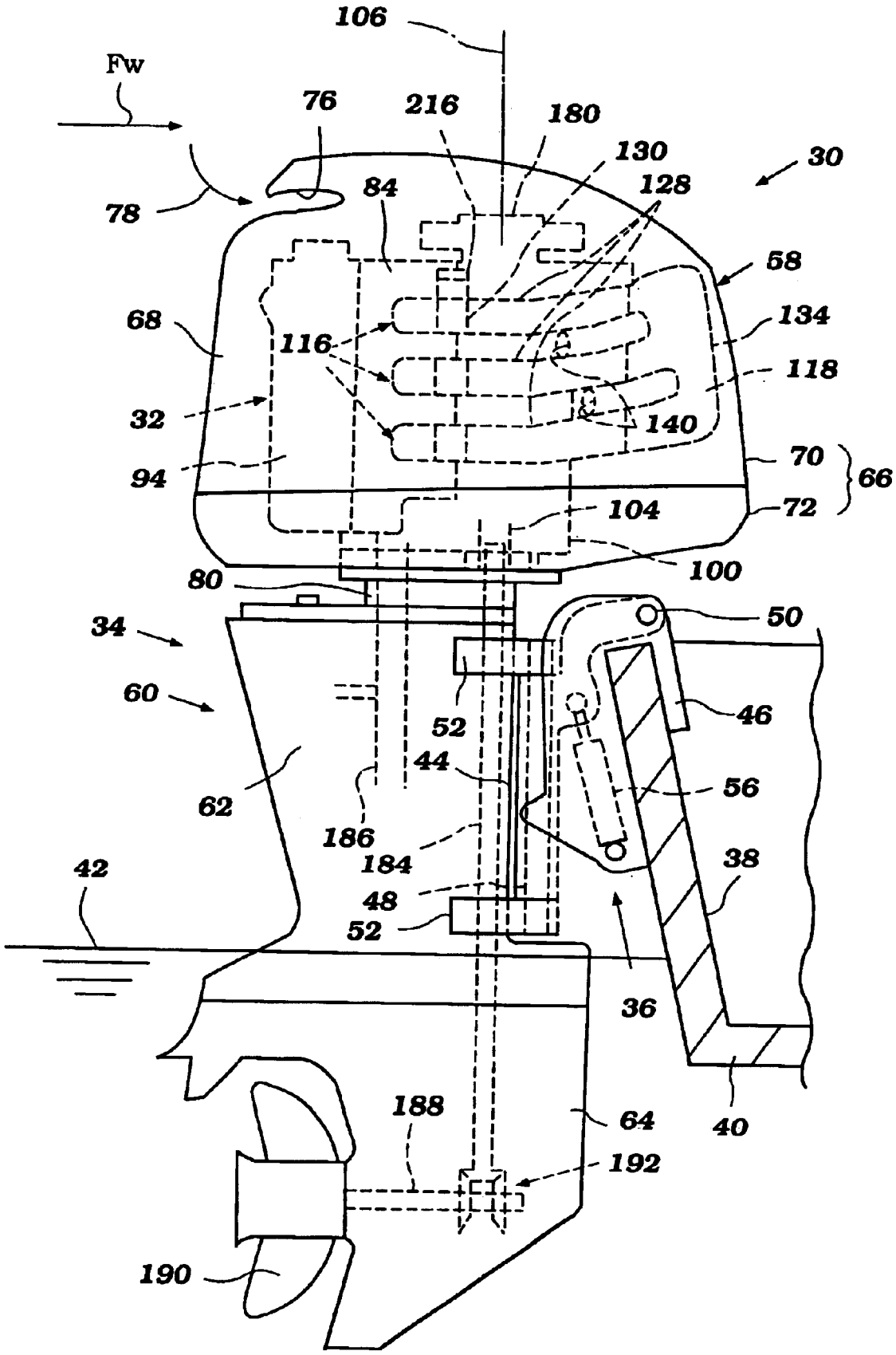
FIG. 1 is a side elevational view of an outboard motor configured in accordance with a preferred embodiment of the present invention. An associated watercraft is partially shown in section.
Figure 2:
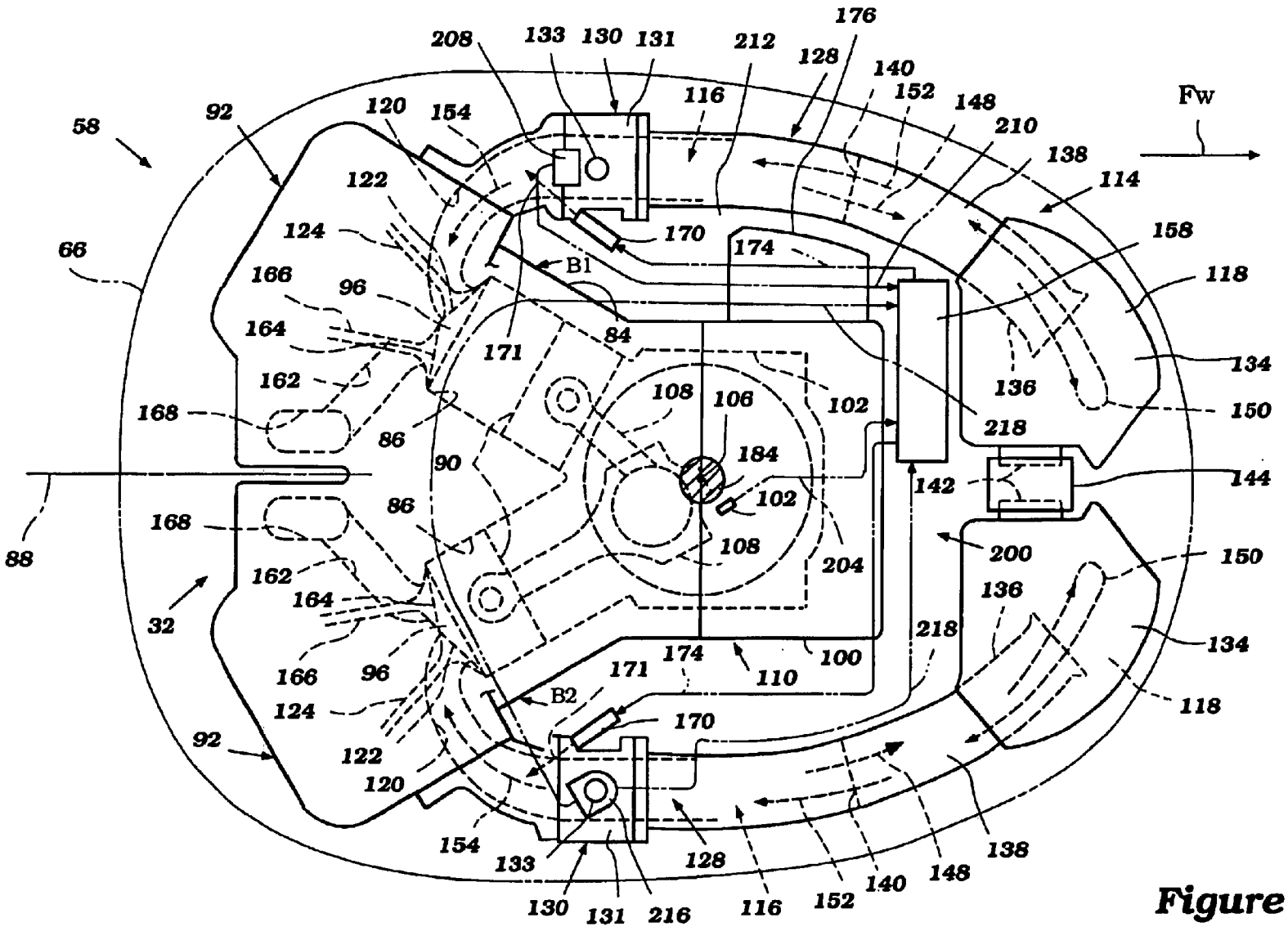
FIG. 2 is a top plan view of an engine of the outboard motor. A protective cowling is shown in phantom line.
Figure 3:
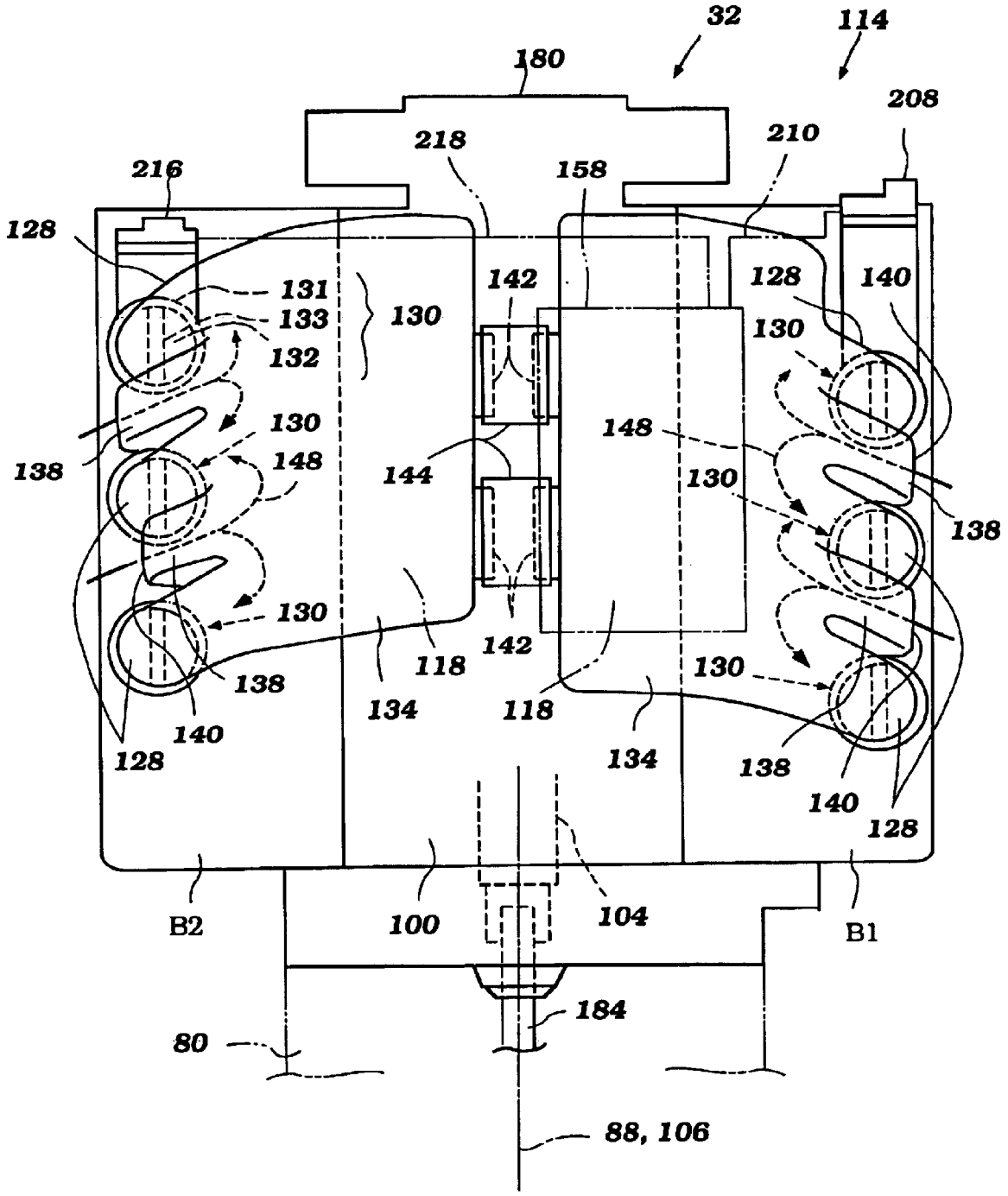
FIG. 3 is a front view of the engine with an exhaust guide member. The exhaust guide member is partially shown in phantom line.

With reference to FIGS. 1–3, an overall construction of an outboard motor 30 that employs an internal combustion engine 32 configured in accordance with certain features, aspects and advantages of the present invention will be described. The engine 32 has particular utility in the context of a marine drive, such as the outboard motor 30 for instance, and thus is described in the context of an outboard motor. The engine 32, however, can be used with other types of marine drives (i.e., inboard motors, inboard/outboard motors, etc.) and also certain land vehicles, which includes lawnmowers, motorcycles, go carts, all terrain vehicles and the like. Furthermore, the engine 32 can be used as a stationary engine for some applications that will become apparent to those of ordinary skill in the art.

In the illustrated arrangement, the outboard motor 30 generally comprises a drive unit 34 and a bracket assembly 36. The bracket assembly 36 supports the drive unit 34 on a transom 38 of an associated watercraft 40 and places a marine propulsion device in a submerged position with the watercraft 40 resting relative to a surface 42 of a body of water. The bracket assembly 36 preferably comprises a swivel bracket 44, a clamping bracket 46, a steering shaft 48 and a pivot pin 50.

The steering shaft 48 typically extends through the swivel bracket 44 and is affixed to the drive unit 34 by top and bottom mount assemblies 52. The steering shaft 48 is pivotally journaled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 34 thus can be tilted or trimmed about the pivot pin 50.

As used through this description, the terms "forward," "forwardly" and "front" mean at or to the side where the bracket assembly 36 is located, unless indicated otherwise or otherwise readily apparent from the context use. The arrows FW of FIGS. 1, 2, 4 and 5 indicate the forward direction. The terms "rear," "reverse," "backwardly" and "rearwardly" mean at or to the opposite side of the front side.

A hydraulic tilt and trim adjustment system 56 preferably is provided between the swivel bracket 44 and the clamping bracket 46 for tilt movement (raising or lowering) of the swivel bracket 44 and the drive unit 34 relative to the clamping bracket 46. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 58 and a housing unit 60, which includes a driveshaft housing 62 and a lower unit 64. The power head 58 is disposed atop the housing unit 60 and includes an internal combustion engine 32 that is positioned within a protective cowling assembly 66, which preferably is made of plastic. In most arrangements, the protective cowling assembly 66 defines a generally closed cavity 68 in which the engine 32 is disposed. The engine, thus, is generally protected from environmental elements within the enclosure defined by the cowling assembly 66.

The protective cowling assembly 66 preferably comprises a top cowling member 70 and a bottom cowling member 72. The top cowling member 70 preferably is detachably affixed to the bottom cowling member 72 by a coupling mechanism so that a user, operator, mechanic or repairperson can access the engine 32 for maintenance or for other purposes. In some arrangements, the top cowling member 70 is hingedly attached to the bottom member such that the top cowling member 70 can be pivoted away from the bottom cowling member for access to the engine. Preferably, such a pivoting allows the top cowling member to be pivoted about the rear end of the outboard motor, which facilitates access to the engine from within the associated watercraft 40.

The top cowling member 70 preferably has a rear intake opening 76 defined through an upper rear portion. A rear intake member with one or more air ducts is unitarily formed with or is affixed to the top cowling member 70. The rear intake member, together with the upper rear portion of the top cowling member 70, generally defines a rear air intake space. Ambient air is drawn into the closed cavity 68 via the rear intake opening 76 and the air ducts of the rear intake member as indicated by the arrow 78 of FIG. 1. Typically, the top cowling member 70 tapers in girth toward its top surface, which is in the general proximity of the air intake opening 76. The taper helps to reduce the lateral dimension of the outboard motor, which helps to reduce the air drag on the watercraft during movement.

The bottom cowling member 72 preferably has an opening through which an upper portion of an exhaust guide member or support member 80 extends. The exhaust guide member 80 preferably is made of aluminum alloy and is affixed atop the driveshaft housing 62. The bottom cowling member 72 and the exhaust guide member 80 together generally form a tray. The engine 32 is placed onto this tray and can be affixed to the exhaust guide member 80. The exhaust guide member 80 also defines an exhaust discharge passage through which burnt charges (e.g., exhaust gases) from the engine 32 pass.

The engine 32 in the illustrated embodiment preferably operates on a four-cycle combustion principle. With reference now to FIG. 2, the presently preferred engine 32 has a cylinder block 84 configured as a V shape. The cylinder block 84 thus defines two cylinder banks B1, B2 which extend side by side with each other. In the illustrated arrangement, the cylinder bank B1 is disposed on the port side, while the cylinder bank B2 is disposed on the starboard side. In the illustrated arrangement, each cylinder bank B1, B2 has three cylinder bores 86 such that the cylinder block 84 has six cylinder bores 86 in total. The cylinder bores 86 of each bank B1, B2 extend generally horizontally and are generally vertically spaced from one another. As used in this description, the term "horizontally" means that the subject portions, members or components extend generally in parallel to the water surface 42 (i.e., generally normal to the direction of gravity) when the associated watercraft 40 is substantially stationary with respect to the water surface 42 and when the drive unit 34 is not tilted (i.e., is placed in the position shown in FIG. 1). The term "vertically" in turn means that portions, members or components extend generally normal to those that extend horizontally.

The illustrated engine 32 generally is symmetrical about a longitudinal center plane 88 that extends generally vertically and fore to aft of the outboard motor 30. This type of engine, however, merely exemplifies one type of engine on which various aspects and features of the present invention can be suitably used. Preferably, the engine has at least two cylinder banks which extend separately of each other. For instance, an engine having an opposing cylinder arrangement can use certain features of the present invention. Nevertheless, engines having other cylinder arrangements (in-line, opposing, etc.), and operating on other combustion principles (e.g., crankcase compression two-stroke or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes multiple cylinder bores.

A moveable member, such as a reciprocating piston 90, moves relative to the cylinder block 84 in a suitable manner. In the illustrated arrangement, a piston 90 reciprocates within each cylinder bore 86.

Because the cylinder block 84 is split into the two cylinder banks B1, B2, each cylinder bank B1, B2 extends outward at an angle to an independent first end in the illustrated arrangement. A pair of cylinder head assemblies or members 92 are affixed to the respective ends of the cylinder banks B1, B2 to close the ends of the cylinder bores. The cylinder head assemblies 92, together with the associated pistons 90 and cylinder bores 86, preferably define six combustion chambers 96. Of course, the number of combustion chambers can vary, as indicated above.

A crankcase member 100 closes the other end of the cylinder bores 86 and, together with the cylinder block 84, defines a crankcase chamber 102. A crankshaft 104 extends generally vertically through the crankcase chamber 102 and can be journaled for rotation about a rotational axis 106 by several bearing blocks. The rotational axis 106 of the crankshaft 104 preferably is on the longitudinal center plane 88. Connecting rods 108 couple the crankshaft 104 with the respective pistons 90 in any suitable manner. Thus, the reciprocal movement of the pistons 90 rotates the crankshaft 104.

Preferably, the crankcase member 100 is located at the forward-most position of the engine 32, with the cylinder block 84 and the cylinder head assemblies 92 being disposed rearward from the crankcase member 100, one after another. Generally, the cylinder block 84 (or individual cylinder bodies), the cylinder head assemblies 92, and the crankcase member 100 together define an engine body 110. Preferably, at least these major engine portions 84, 92, 100 are made of aluminum alloy. The aluminum alloy advantageously increases strength over cast iron while decreasing the weight of the engine body 110.

The engine 32 also comprises an air induction system 114. The air induction system 114 draws air from within the cavity 68 to the combustion chambers 96. The air induction system 114 preferably comprises six intake passages 116 and a pair of plenum chambers 118. In the illustrated arrangement, each cylinder bank B1, B2 is allotted with three intake passages 116 and one plenum chamber 118.

The most-downstream portions of the intake passages 116 are defined within the cylinder head assemblies 92 as inner intake passages 120. The inner intake passages 120 communicate with the combustion chambers 96 through intake ports 122, which are formed at inner surfaces of the cylinder head assemblies 92. Typically, each of the combustion chambers 96 has one or more intake ports 122. Intake valves 124 are slidably disposed at each cylinder head assembly 92 to move between an open position and a closed position. As such, the valves 124 act to open and close the ports 122 to control the flow of air into the combustion chamber 96. Biasing members, such as springs, are used to urge the intake valves 124 toward the respective closed positions by acting between a mounting boss formed on each cylinder head assembly 92 and a corresponding retainer that is affixed to each of the valves 124. When each intake valve 124 is in the open position, the inner intake passage 120 that is associated with the intake port 122 communicates with the associated combustion chamber 96.

Outer portions of the intake passages 116, which are disposed outside of the cylinder head assemblies 92, preferably are defined with intake conduits 128. The intake conduits on one side form an intake unit. The illustrated induction system 114, thus, has a pair of intake units, each of which comprises three intake conduits 128.

Each intake conduit 128 preferably includes a control mechanism or throttle valve assembly 130; however, the present pressure sensing system can be used with throttleless engines as well. In the illustrated arrangement, each intake conduit 128 is formed with two pieces 128*a*, 128*b* with the throttle valve assembly 130 positioned therebetween. The first piece 128*a* forms a runner, while the second piece 128*b*, together with other pieces of other intake conduits 128, forms an intake manifold. Each manifold piece 128*b* is coupled with the cylinder head assembly 92. The intake conduits 128 allotted to the cylinder bank B1 extend forwardly along a side surface of the engine body 110 on the port side from the cylinder head assembly 92 to the front of the crankcase member 100. The intake conduits 128 allotted to the cylinder bank B2 similarly extend forwardly along a side surface of the engine body 110 on the starboard side from the cylinder head assembly 92 to the front of the crankcase member 100. The runner pieces 128*a* preferably are made of plastic, while the manifold pieces 128*b* preferably are made of aluminum alloy or plastic.

Each throttle valve assembly 130 preferably includes a throttle body 131 and a throttle valve 132 disposed within the throttle body 131. The throttle bodies 129 preferably are made of aluminum alloy or plastic. Preferably, the throttle valves 132 are butterfly valves that have valve shafts 133 journaled for pivotal movement about a generally vertical axis. In some arrangements, the valve shafts 133 are linked together and are connected to a control linkage. The control linkage would be connected to an operational member, such as a throttle lever, that is provided on the watercraft or otherwise proximate the operator of the watercraft. The operator can control the opening degree of the throttle valves 132 in accordance with operator demand through the control linkage. That is, the throttle valve assemblies 130 can measure or regulate amounts of air that flow through the intake passages 116 to the combustion chambers 96 in response to the operation of the operational member by the operator. Normally, the greater the opening degree, the higher the rate of airflow and the higher the engine speed.

The respective plenum chambers 118 preferably are defined with plenum chamber units or voluminous units 134 which are disposed side by side in front of the crankcase member 100. Preferably, the plenum chambers 134 are arranged substantially symmetrically relative to the longitudinal center plane 88. In the illustrated arrangement, each forward end portion 136 of the intake conduits 128 is housed within each plenum chamber unit 134.

As illustrated in FIG. 3, each plenum chamber unit 134 preferably has two air inlets 138, which extend generally rearwardly between the respective intake conduits 128. That is, two of the intake conduits 128 are formed with one inlet 138 extending therebetween. The respective air inlets 138 define inlet openings 140 through which air is drawn into the plenum chambers 118. The plenum chamber units 134 also have other two openings 142 which are defined on another side and which are spaced apart vertically from one another. The openings 142 of one plenum chamber unit 134 preferably are formed opposite to the openings 142 of the other plenum chamber unit 134 and are coupled with each other by balancer pipes 144. Advantageously, this construction provides a manner of roughly equalizing the pressures within each chamber unit 134.

The plenum chambers 118 coordinate air delivered to each intake passage 116 and also act as silencers to reduce intake noise. In other words, the chambers 118 act to reduce the pulsation energy within the intake system and to smooth the airflow being introduced to the engine. The air in both of the chambers 118 also is coordinated with one another through the balancer pipes 144.

The plenum chamber units 134 and the balancer pipes 144 preferably are made of plastic. The foregoing runner pieces 128*a* in this arrangement are unitarily formed with the associated plenum chamber unit 134.

The air within the closed cavity 68 is drawn into the plenum chambers 118 through the inlet openings 140 as indicated by the arrows 148 of FIGS. 2 and 3. The air expands within the plenum chambers 118 to reduce pulsation and then enters the outer intake passages 116 through the end portions 136, as indicated by the arrows 150 of FIG. 2. The air passes through the outer intake passages 116 and flows into the inner intake passages 120 as indicated by the arrows 152, 154 of FIG. 2. As described, the level of airflow is measured by the throttle valve assemblies 130 before the air enters the inner intake passages 120.

The induction system 114 can include an idle air delivery mechanism that delivers idle air to the combustion chambers 96 when the throttle valves 132 are substantially closed. The downstream portion of the mechanism 158 is connected to the air intake passages 116 downstream of the throttle valve assemblies 130. In some arrangements, the mechanism can be configured such as the mechanism set forth in a co-pending U.S. patent application Ser. No. 09/906,570, filed Jul. 16, 2001, and entitled AIR INDUCTION SYSTEM FOR ENGINE, the entire contents of which is hereby incorporated by reference. In other arrangements, the idle delivery mechanism can bypass the throttle valve assemblies 130. In other words, air to the idle delivery mechanism is drawn from the intake passages 116 at a location upstream of the throttle assemblies in a manner similar to that disclosed in U.S. Pat. No. 6,015,319, which is hereby incorporated by reference. In both groups of arrangements, the idle delivery mechanism preferably has an idle speed control (ISC) valve operating under the control of an electronic control unit (ECU), which will be described later.

The engine 32 also includes an exhaust system that routes burnt charges, i.e., exhaust gases, to a location outside of the outboard motor 30. Each cylinder head assembly 92 defines a set of inner exhaust passages 162 that communicate with the combustion chambers 96 through one or more exhaust ports 164, which may be defined at the inner surfaces of the respective cylinder head assemblies 92. The exhaust ports 164 can be selectively opened and closed by exhaust valves 166. The construction of each exhaust valve and the arrangement of the exhaust valves are substantially the same as the intake valve and the arrangement thereof, respectively. Thus, further description of these components is deemed unnecessary.

Exhaust manifolds 168 preferably are defined generally vertically within the cylinder block 84 between the cylinder bores 86 of both the cylinder banks B1, B2. The exhaust manifolds 168 communicate with the combustion chambers 96 through the inner exhaust passages 162 and the exhaust ports 164 to collect exhaust gases therefrom. The exhaust manifolds 168 are coupled with the exhaust discharge passage of the exhaust guide member 80. When the exhaust ports 164 are opened, the combustion chambers 96 communicate with the exhaust discharge passage through the exhaust manifolds 168.

A valve cam mechanism preferably is provided for actuating the intake and exhaust valves 124, 166 in each cylinder bank B1, B2. Preferably, the valve cam mechanism includes one or more camshafts per cylinder bank, which camshafts extend generally vertically and are journaled for rotation relative to the cylinder head assemblies 92. The camshafts have cam lobes to push valve lifters that are affixed to the respective ends of the intake and exhaust valves 124, 166 in any suitable manner. The cam lobes repeatedly push the valve lifters in a timed manner, which is in proportion to the engine speed. The movement of the lifters generally is timed by rotation of the camshafts to appropriately actuate the intake and exhaust valves 124, 166.

A camshaft drive mechanism (not shown) preferably is provided for driving the valve cam mechanism. Thus, the intake and exhaust camshafts comprise intake and exhaust driven sprockets positioned atop the intake and exhaust camshafts, respectively, while the crankshaft 104 has a drive sprocket positioned atop thereof. A timing chain or belt is wound around the driven sprockets and the drive sprocket. The crankshaft 104 thus drives the respective camshafts through the timing chain in the timed relationship. Because the camshafts must rotate at half of the speed of the rotation of the crankshaft 104 in a four-cycle engine, a diameter of the driven sprockets is twice as large as a diameter of the drive sprocket.

The engine 32 preferably has indirect, port or intake passage fuel injection. The fuel injection system preferably comprises six fuel injectors 170 with one fuel injector allotted for each one of the respective combustion chambers 96. The fuel injectors 170 preferably are mounted on the throttle bodies 131 and a pair of fuel rails connects the respective fuel injectors 170 with each other on each cylinder bank B1, B2. The fuel rails also define portions of the fuel conduits to deliver fuel to the injectors 170.

Each fuel injector 170 preferably has an injection nozzle directed downstream within the associated intake passage 116, which is downstream of the throttle valve assembly 130. The fuel injectors 170 spray fuel into the intake passages 130, as indicated by the arrows 171 of FIG. 2, under control of an electronic control unit (ECU) 172. Control signals of the fuel injectors 170 are transmitted to the fuel injectors 170 from the ECU 158 through control lines 174. The ECU 158 controls both the initiation timing and the duration of the fuel injection cycle of the fuel injectors 170 so that the nozzles spray a proper amount of fuel each combustion cycle.

The ECU 158 preferably is disposed between a forward surface of the crankcase member 100 and the plenum chamber unit 134 on the port side, and preferably is mounted on the forward surface of the crankcase member 100. Air is drawn over the ECU 158 to help cool the ECU during operation of the engine.

Typically, a fuel supply tank disposed on a hull of the associated watercraft 40 contains the fuel. The fuel is delivered to the fuel rails through the fuel conduits and at least one fuel pump, which is arranged along the conduits. The fuel pump pressurizes the fuel to the fuel rails and finally to the fuel injectors 170. A vapor separator 176 preferably is disposed along the conduits to separate vapor from the fuel and can be mounted on the engine body 110 at the side surface on the port side. A pressure regulator 177 (FIG. 4) can be provided in the fuel injection system to keep fuel pressure in an appropriate level. The pressure regulator 177 will be described in greater detail with reference to FIG. 4 later.

The fuel injection system is disclosed, for example, in U.S. Pat. Nos. 5,873,347, 5,915,363 and 5,924,409, the disclosures of which are hereby incorporated by reference. It should be noted that a direct fuel injection system that sprays fuel directly into the combustion chambers can replace the indirect fuel injection system described above. Moreover, other charge forming devices, such as carburetors, can be used instead of the fuel injection systems.

The engine 32 further comprises an ignition or firing system. Each combustion chamber 96 is provided with a spark plug which preferably is disposed between the intake and exhaust valves 124, 166. Each spark plug has electrodes that are exposed into the associated combustion chamber 96 and that are spaced apart from each other with a small gap. The spark plugs are connected to the ECU 158 through appropriate control lines and an ignition device, such as ignition coils 178, are provided such that ignition timing is controlled by the ECU 158. The spark plugs generate a spark between the electrodes to ignite an air/fuel charge in the combustion chamber 96 at selected ignition timing under control of the ECU 158.

In the illustrated engine 32, the pistons 90 reciprocate between top dead center and bottom dead center. When the crankshaft 104 makes two rotations, the pistons 90 generally move from the top dead center position to the bottom dead center position (the intake stroke), from the bottom dead center position to the top dead center position (the compression stroke), from the top dead center position to the bottom dead center position (the power stroke) and from the bottom dead center position to the top dead center position (the exhaust stroke). During the four strokes of the pistons 90, the camshafts make one rotation and actuate the intake and exhaust valves 124, 166 to open the intake and exhaust ports 122, 164 during the intake stroke and the exhaust stroke, respectively.

Generally, during the intake stroke, air is drawn into the combustion chambers 96 through the air intake passages 116 and fuel is injected into the intake passages 116 by the fuel injectors 170. The air and the fuel thus are mixed to form the air/fuel charge in the combustion chambers 96. Slightly before or during the power stroke, the respective spark plugs ignite the compressed air/fuel charge in the respective combustion chambers 96. The air/fuel charge thus rapidly burns during the power stroke to move the pistons 90. The burnt charge, i.e., exhaust gases, then are discharged from the combustion chambers 96 during the exhaust stroke.

The engine 32 may comprise a cooling system, a lubrication system and other systems, mechanisms or devices other than the systems described above.

A flywheel assembly 180 preferably is positioned above atop the crankshaft 104 and is mounted for rotation with the crankshaft 104. The flywheel assembly 180 comprises a flywheel magneto or AC generator that supplies electric power to various electrical components, such as the fuel injection system, the ignition system and the ECU 158.

With reference back to FIG. 1, the driveshaft housing 62 depends from the power head 58 to support a driveshaft 184 which is coupled with the crankshaft 104 and which extends generally vertically through the driveshaft housing 62. The driveshaft 184 is journaled for rotation and is driven by the crankshaft 104. The driveshaft housing 62 preferably defines an internal section 186 of the exhaust system that leads the majority of exhaust gases to the lower unit 64. The internal section 186 includes an idle discharge portion that is branched off from a main portion of the internal section 186 to discharge idle exhaust gases directly out to the atmosphere through a discharge port that is formed on a rear surface of the driveshaft housing 62 in idle speed of the engine 32. The exhaust internal section 186 is schematically shown in FIG. 1 to include a portion of the exhaust manifolds 168 and the exhaust discharge passage.

The lower unit 64 depends from the driveshaft housing 62 and supports a propulsion shaft 188 that is driven by the driveshaft 184. The propulsion shaft 188 extends generally horizontally through the lower unit 64 and is journaled for rotation. A propulsion device is attached to the propulsion shaft 188. In the illustrated arrangement, the propulsion device is a propeller 190 that is affixed to an outer end of the propulsion shaft 188. The propulsion device, however, can take the form of a dual counter-rotating system, a hydrodynamic jet, or any of a number of other suitable propulsion devices.

A transmission 192 preferably is provided between the driveshaft 184 and the propulsion shaft 188, which lie generally normal to each other (i.e., at a 90° shaft angle) to couple together the two shafts 184, 188 by bevel gears. The outboard motor 30 has a clutch mechanism that allows the transmission 192 to change the rotational direction of the propeller 190 among forward, neutral or reverse.

The lower unit 64 also defines an internal section of the exhaust system that is connected with the internal exhaust section 186 of the driveshaft housing 62. At engine speeds above idle, the exhaust gases generally are discharged to the body of water surrounding the outboard motor 30 through the internal sections and then a discharge section defined within the hub of the propeller 190. Incidentally, the exhaust system can include a catalytic device at any location in the exhaust system to purify the exhaust gases.

With continued reference to FIGS. 2 and 3, a control system 200 including the ECU 158 and a variety of sensors will be described below.

In the illustrated embodiment, a crankshaft angle position sensor 202 preferably is provided proximate the crankshaft 104. The angle position sensor 202, when measuring crankshaft angle versus time, outputs a crankshaft rotational speed signal or engine speed signal that is sent to the ECU 158 through a sensor signal line or wire 204. In one arrangement, the angle position sensor 202 comprises a pulsar coil positioned adjacent to the crankshaft 104 and a projection or cut formed on the crankshaft 104. The pulsar coil generates a pulse when the projection or cut passes proximate the pulsar coil. In some arrangements, the number of pulses can be counted. The angle position sensor 202 thus can sense not only a specific crankshaft angle but also a rotational speed of the crankshaft 104, i.e., engine speed. Of course, other types of speed sensors also can be used and such speed sensors can be suitably positioned depending upon the application.

Figure 4:
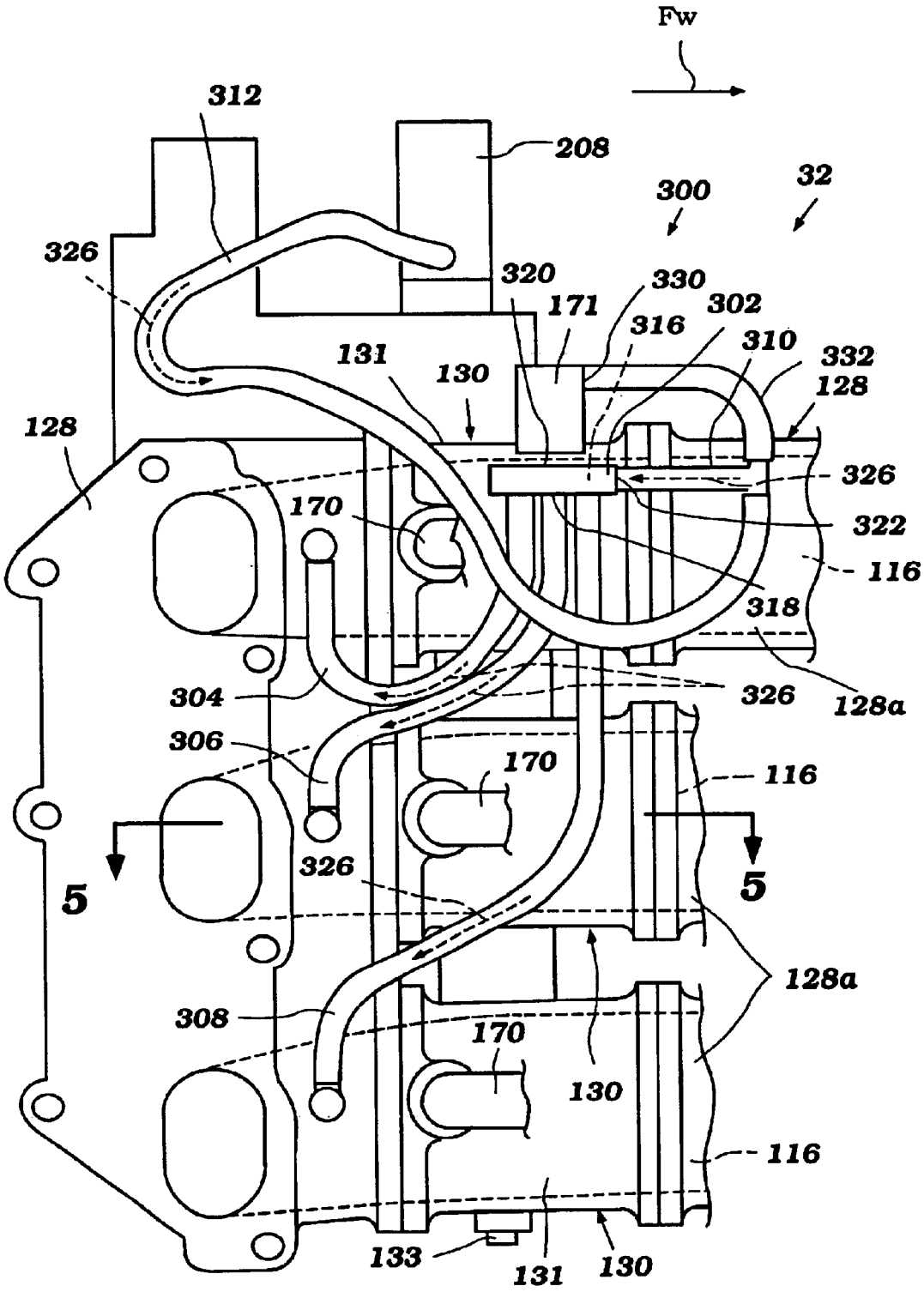
FIG. 4 is an enlarged partial side elevational view of the engine showing an intake pressure sensor arrangement configured in accordance with the preferred embodiment of the present invention.
Figure 5:
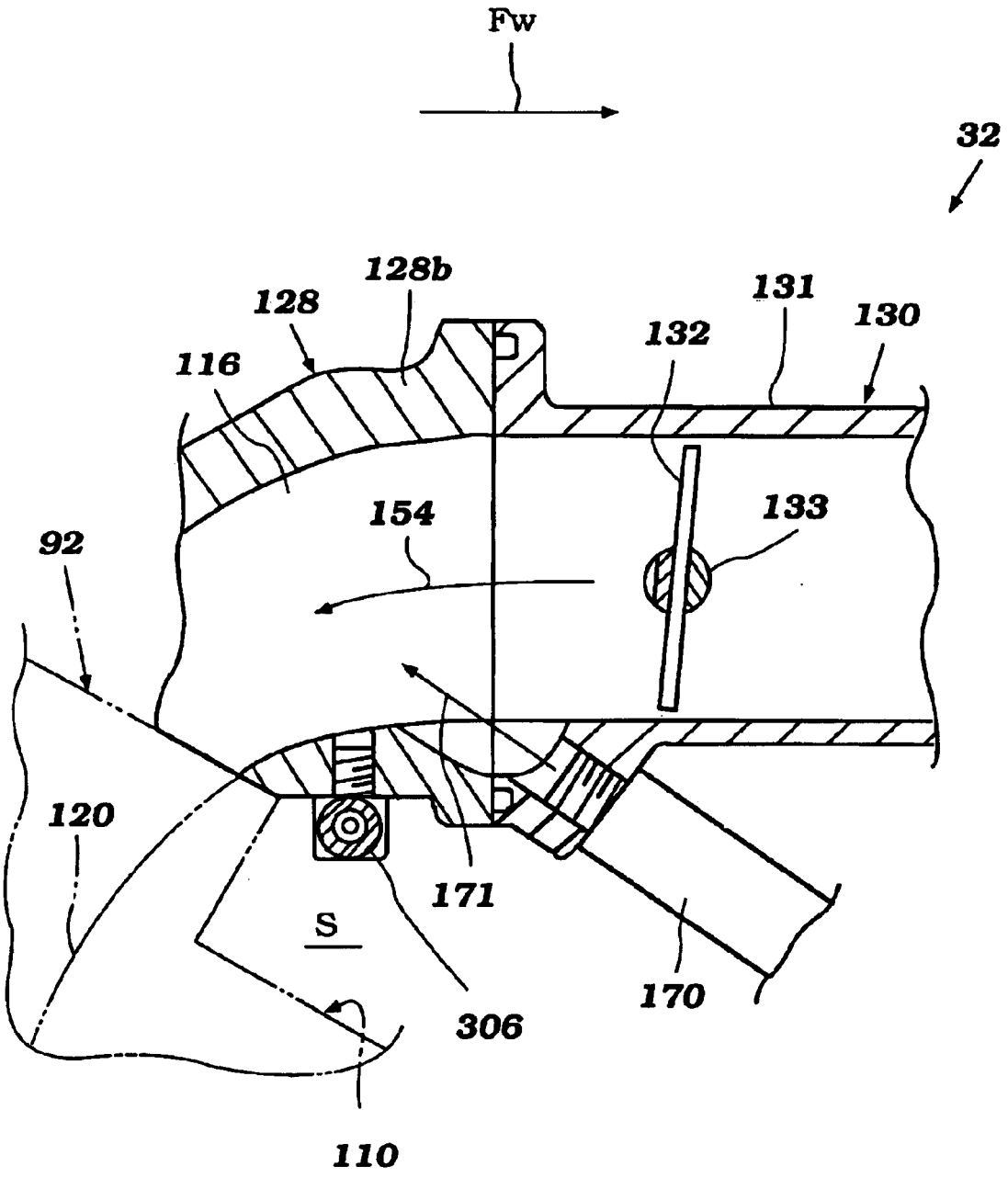
FIG. 5 is an enlarged partial top plan view of the engine taken along the line 5—5 of FIG. 4.

An air intake pressure sensor 208 preferably is positioned atop the uppermost throttle assembly 130 for the intake passage 116 of the cylinder bank B1 on the port side. The intake pressure sensor 208 is connected with the respective intake passages 116 by an intake pressure sensor arrangement. An exemplifying intake pressure sensor arrangement 300 is illustrated in FIGS. 4 and 5 and will be described shortly with reference to these figures. The intake pressure sensor 208 senses the intake pressure in these passages 116 during engine operation. The sensed signal is sent to the ECU 158 through a sensor signal line or wire 210. The illustrated signal line 210 extends in a space 212 defined by the side surface of the engine body 110 on the port side and the intake conduit 128 of the cylinder bank B1. The signal line 210 can lie either above or below the vapor separator 176. A rack, for example, extending from the engine body 110 or the intake conduit 128 preferably supports the wire 210. This signal can be used for determining the operator's demand or engine load. Of course, other suitable sensors and mounting positions also can be used.

A throttle valve position sensor 216 preferably is provided atop of and proximate the valve shaft assembly 133 of the throttle assembly 130 for the intake passage 116 of the cylinder bank B2 on the starboard side. The throttle valve position sensor 216 senses an opening degree or opening position of the throttle valves 132 on this side. A sensed signal is sent to the ECU 158 through a sensor signal line or wire 218. This signal can also be used for determining the operator's demand or engine load. The illustrated signal line 218 extends over the cylinder block 84 and further extends in the space 212 and can lie either above or below the vapor separator 176. Another rack or the foregoing rack can also support the wire 218. Alternatively, the signal line 218 can extend in a space 220 defined by the side surface of the engine body 110 on the starboard side and the intake conduit 128 of the cylinder bank B2 and also by the forward surface of the engine body 110 and the plenum chamber unit 134 for the intake conduit 128 on the starboard side. This arrangement is advantageous because simultaneous snapping risks of both the wires 210 218 can be greatly reduced in the event one side of the power head 58 is damaged.

The operator's demand or engine load, as determined by the throttle opening degree, is sensed by the throttle position sensor 216. Generally, in proportion to the change of the throttle opening degree, the intake air pressure also varies and is sensed by the intake pressure sensor 208. The throttle valve 132 is opened through the use of an operator control (i.e., throttle lever) to increase the speed of the watercraft. When the throttle valve opening is widened toward a certain position when compared with the previous position, more air is induced into the combustion chambers 96 through the intake passages 116. The intake pressure simultaneously increases at this moment. The engine load can also increase when the associated watercraft 40 advances against wind. In this situation, the operator also operates the throttle lever to recover the speed that may be lost.

The signal lines preferably are configured with hard-wires or wire-harnesses. In some aspects of the present invention, however, the signals can be sent through emitter and detector pairs, infrared radiation, radio waves or the like. The type of signal and the type of connection can be varied between sensors or the same type can be used with all sensors.

The ECU 158 can be designed as a feedback control system using the signals of the various sensors. The ECU 158 preferably has various control maps which typically employ parameters such as, for example, the engine speed, the intake pressure and the throttle valve position that are sent from the sensors to determine an optimum control condition at every moment and then controls the fuel injection system, the ignition system and other actuators, if any, in accordance with the determined control condition.

The signals of both the intake pressure sensor 208 and the throttle position sensor 216 indicate different aspects of the same intake air condition. Although any control strategy can be applied, in the illustrated embodiment, while the signal of the intake pressure sensor 208 primarily is used for determining an amount of the injected fuel with the engine speed signal, the signal of the throttle valve position sensor 216 primarily is used for increasing or decreasing the injected fuel amount in response to the acceleration demand or deceleration demand, respectively. It should be noted that, if the intake pressure sensor or the throttle valve position sensor (or the air flow meter, if any) on one side is normal, a minimum control by the ECU can be done because all of the signals from the sensors can represent generally the same intake air condition.

As thus described, in the illustrated embodiment, the intake pressure sensor and the throttle valve position sensor are disposed on different sides of the engine relative to each other. This arrangement thus can decrease possibility of impact damage to all of the sensors that sense a condition of intake air. Also, the arrangement increases the amount of maintenance working space per sensor. Furthermore, if the wires that connect the sensors to the ECU are disposed at different locations as indicated in the alternative, the risk of both wire connections being severed at once is greatly be reduced. In addition, the illustrated sensors are positioned atop both the intake conduits. This arrangement is quite suitable for the outboard motor because the positions also are almost the farthest location from the water surface 42 and hence the risk of water splashing onto the sensors can be greatly reduced.

With continued reference to FIGS. 2 and 3 and additional reference to FIGS. 4 and 5, the intake pressure sensor arrangement 300 will now be described. As shown in FIG. 5, the intake pressure sensor arrangement 300 is generally located in a space S defined by the side surface of the engine body 110 and the intake system, including the intake conduit 128, on the starboard side. The illustrated sensor arrangement 300, as best seen in FIG. 4, comprises the intake pressure sensor 208, an accumulator 302, three delivery conduits 304, 306, 308, a T-shaped joint 310 and a common conduit 312.

The accumulator 302 preferably is mounted on the intake conduit 128, specifically, the throttle body 131, disposed atop of the three conduits 128. The accumulator 302 has a generally rectangular parallelepiped shape and defines a relatively small chamber 316 therein. The accumulator 302 defines a bottom outer surface 318, a top outer surface 320 and a vertical outer surface 322. The bottom and top surfaces 318, 320 are longer than the height of the vertical surface 322 and extend generally parallel to a longitudinal axis of the uppermost intake conduit 128 and generally normal to the vertical surface 322. A volume of the chamber 316 can be nominal (i.e., relatively small) and an inner diameter of the accumulator 302 can be slightly larger than an inner diameter of the T-shaped joint 310. In this manner, the accumulator 302 functions similar to a manifold.

The delivery conduits 304, 306, 308 are connected to the accumulator 302 separately of the other delivery conduits (i.e., independently of one another). In the illustrated embodiment, the delivery conduits 304, 306, 308 preferably are coupled with the bottom surface 318 of the accumulator 302 to connect the accumulator 302 to the top, middle and bottom intake passages 116, respectively. The delivery conduits 304, 306, 308 preferably are connected to portions of the respective intake passages 116 downstream of the throttle valves 132.

One end of the T-shaped joint 310 is coupled with the vertical surface 322 of the accumulator 302. The common conduit 312 is coupled with another end of the T-shaped joint 310 to connect the accumulator 302 to the intake pressure sensor 208.

Intake pressure generated in each intake passage 116 thus is sensed by the intake pressure sensor 208 through the delivery conduits 304, 306, 308, the accumulator 302, the T-shaped joint 310 and the common conduit 312. Because the intake pressure is negative pressure, air flow may occur in the conduits 304, 306, 308, 312 and the T-shaped joint 310 as indicated by the arrows 326 of FIG. 4, under certain operating conditions (e.g, when increasing engine speed).

As described above, the delivery conduits converge onto the bottom surface of the accumulator and then the T-shaped joint extends from the vertical surface of the accumulator to be connected to the common conduit. The arrangement thus is neat and orderly even though three delivery conduits are provided. In addition, pulsation in this arrangement is inhibited because all the delivery conduits converge to a single accumulator.

In the illustrated arrangement, pressure regulator 171 of the fuel injection system is disposed in the vicinity of the accumulator 302. More specifically, the pressure regulator 171 is mounted on the throttle valve body 131 so as to be positioned above the top surface 320 of the accumulator 302.

Typically, for instance, the pressure regulator 171 has a return fuel inlet port connected to the fuel injectors 170 and a return fuel outlet port connected to the vapor separator 176. A valve supported by a diaphragm normally disconnects the outlet port from the inlet port with biasing force of a spring. If the pressure of the return fuel from the fuel injectors 170 is greater than the biasing force of the spring, the valve is moved against the spring force by the fuel pressure to connect the outlet port with the inlet port. Thus, the return fuel can flow to the vapor separator 176 to decrease the fuel pressure.

The illustrated pressure regulator 171 additionally has an intake pressure port 330. A regulator conduit 332 is coupled to the port 330 to connect the regulator 171 with a further end of the T-shaped joint 310. The pressure regulator 171 thus is connected to the accumulator 302 and the intake pressure is introduced into the regulator 171 so as to moderate a force biasing an internal valve closed (which accordingly sets fuel pressure) in proportion to inlet vacuum.

Of course, the foregoing description is that of a preferred construction having certain features, aspects and advantages in accordance with the present invention. For instance, the pressure regulator is not necessarily disposed above the accumulator nor is connected with the accumulator. The intake pressure sensor arrangement can include delivery conduits of an even number. Other sensors can be additionally provided to sense the intake air conditions of the engine 32. For example, a type of sensor that directly senses the air amount is applicable, such as moving vane types, heat wire types and Karman Vortex types of air flow meters. Moreover, other sensors that sense other engine running conditions and/or ambient conditions of the engine or outboard motor can be used. For example, an intake air temperature sensor, an engine temperature sensor, an oxygen ($O_2$) sensor, a trim angle sensor and a back pressure sensor are all applicable. Accordingly, various changes and modifications may be made to the above-described arrangements without departing from the spirit and scope of the invention, as defined by the appended claims.

What is claimed is:

1. An internal combustion engine comprising an engine body, a plurality of moveable members moveable relative to the engine body, the engine body and the moveable members together defining a plurality of combustion chambers, a plurality of intake conduits defining intake passages through which air flows, an intake pressure sensor configured to sense intake pressure within the intake passages, an accumulator having at least first and second outer surfaces, a plurality of first conduits coupled with the first surface, at least one second conduit coupled with the second surface, the first conduits connecting the accumulator to the respective intake passages, the second conduit connecting the accumulator to the intake pressure sensor, at least one fuel injector arranged to spray fuel for combustion in the combustion chambers, and a control device configured to control the fuel injector based upon at least a signal of the intake pressure sensor.

2. The engine as set forth in claim 1, wherein the first and second outer surfaces of the accumulator are formed generally normal to each other.

3. The engine as set forth in claim 1, wherein the accumulator is mounted on one of the intake conduits.

4. The engine as set forth in claim 3, wherein the intake conduits extends generally horizontally and parallel to each other, and the accumulator is mounted on an uppermost one of the intake conduits.

5. The engine as set forth in claim 1 additionally comprising a fuel pressure regulator configured to regulate fuel pressure, and a third conduit connecting the pressure regulator with the accumulator.

6. The engine as set forth in claim 5, wherein the accumulator defines a third surface opposite to the first surface, and the pressure regulator is positioned on a side of the third surface.

7. The engine as set forth in claim 6, wherein the first and third surfaces extend generally normal to the second surface.

8. The engine as set forth in claim 1, wherein the intake conduits include throttle valves within the intake passages, and the first conduits are connected to portions of the intake passages that are positioned downstream of the throttle valves.

9. The engine as set forth in claim 1, wherein the first conduits comprise an odd number of conduits.

10. An internal combustion engine comprising an engine body, a plurality of moveable members moveable relative to the engine body, the engine body and the moveable members together defining a plurality of combustion chambers, a plurality of intake conduits defining intake passages through which air flows, the intake conduits extending generally horizontally, an intake pressure sensor configured to sense intake pressure within the intake passages, an accumulator defining at least a bottom surface and a vertical surface, a plurality of first conduits coupled with one of the bottom and vertical surfaces, at least one second conduit coupled with the other surface of the bottom and vertical surfaces, the first conduits connecting the accumulator to the respective intake passages, the second conduit connecting the accumulator to the intake pressure sensor, at least one fuel injector arranged to spray fuel for combustion in the combustion chambers, and a control device configured to control the fuel injector based upon at least a signal of the intake pressure sensor.

11. The engine as set forth in claim 10, wherein the first conduits are coupled with the bottom surface, and the second conduit is coupled with the vertical surface.

12. The engine as set forth in claim 10, wherein the accumulator is mounted on one of the intake conduits and is positioned such that the bottom surface extends generally parallel to a longitudinal axis of the intake conduit.

13. The engine as set forth in claim 10, wherein the first conduits comprise an odd number of conduits.

14. The engine as set forth in claim 10 additionally comprising a pressure regulator configured to regulate pressure of the fuel, and a third conduit connecting the pressure regulator with the accumulator so that the pressure of the fuel is adjustable with the intake pressure.

15. The engine as set forth in claim 14, wherein the accumulator defines a top surface, and the pressure regulator is positioned on a side of the top surface.

16. An outboard motor comprising an internal combustion engine, and a support member arranged to support the engine, the engine comprising an engine body, a plurality of moveable members moveable relative to the engine body, the engine body and the moveable members together defining a plurality of combustion chambers, a plurality of intake conduits defining intake passages through which air flows, an intake pressure sensor configured to sense intake pressure within the intake passages, an accumulator defining at least first and second outer surfaces, a plurality of first conduits coupled with the first surface, at least one second conduit coupled with the second surface, the first conduits connecting the accumulator to the respective intake passages, the second conduit connecting the accumulator to the intake pressure sensor, at least one fuel injector arranged to spray fuel for combustion in the combustion chambers, and a control device configured to control the fuel injector based upon at least a signal of the intake pressure sensor.

17. An internal combustion engine comprising an engine body, a plurality of moveable members moveable relative to the engine body, the engine body and the moveable members together defining a plurality of combustion chambers, a plurality of intake conduits defining intake passages through which air flows, an intake pressure sensor configured to sense intake pressure within the intake passages, an accumulator, a plurality of first conduits, each first conduit being coupled with the accumulator separately of the other first conduits, at least one second conduit coupled with the accumulator, the first conduits connecting the accumulator to the respective intake passages, the second conduit connecting the accumulator to the intake pressure sensor, at least one fuel injector arranged to spray fuel for combustion in the combustion chambers, and a control device configured to control the fuel injector based upon at least a signal of the intake pressure sensor.

18. An internal combustion engine comprising an engine body, a plurality of moveable members moveable relative to the engine body, the engine body and the moveable members together defining a plurality of combustion chambers, a plurality of intake conduits defining intake passages through which air flows, an intake pressure sensor configured to sense intake pressure within the intake passages, an accumulator, a plurality of first conduits coupled with the accumulator, at least one second conduit coupled with the accumulator, the first conduits connecting the accumulator to the respective intake passages, the second conduit connecting the accumulator to the intake pressure sensor, at least one fuel injector arranged to spray fuel for combustion in the combustion chambers, a fuel pressure regulator in communication with the fuel injector to regulate fuel pressure at the fuel injector, and a third conduit connecting the accumulator to the fuel pressure regulator.

19. The engine as set forth in claim 18 additionally comprising a T-fitting connected to the accumulator, and the second and third conduits are also connected to the T-fitting.

20. The engine as set forth in claim 18, wherein each of the first conduits connects to the accumulator independently of the another first conduits.

* * * * *